US008011447B2

(12) United States Patent
Keniston et al.

(10) Patent No.: US 8,011,447 B2
(45) Date of Patent: Sep. 6, 2011

(54) AUTOMATED DRILL STRING POSITION SURVEY

(75) Inventors: Scott David Keniston, Pinjarra Hills (AU); Paul J. A. Levers, Indooroopilly (AU)

(73) Assignee: CMTE Development Limited, Pinjarra Hills, Queensland (AU)

( * ) Notice: Subject to any disclaimer, the term of this patent is extended or adjusted under 35 U.S.C. 154(b) by 403 days.

(21) Appl. No.: 10/597,139

(22) PCT Filed: Jan. 24, 2005

(86) PCT No.: PCT/AU2005/000076

§ 371 (c)(1),
(2), (4) Date: Jul. 12, 2006

(87) PCT Pub. No.: WO2005/071225

PCT Pub. Date: Aug. 4, 2005

(65) Prior Publication Data

US 2007/0151761 A1 Jul. 5, 2007

(30) Foreign Application Priority Data

Jan. 22, 2004 (AU) ..... 2004900298

(51) Int. Cl.
*E21B 47/02* (2006.01)

(52) U.S. Cl. ..... 175/45; 175/73

(58) Field of Classification Search ..... 175/45, 175/73, 152.02, 152.45, 40; 73/152.02, 152.45; 173/141, 4; 299/1.05, 1.8
See application file for complete search history.

(56) References Cited

U.S. PATENT DOCUMENTS 2,155,552 A * 4/1939 Jones ..... 33/305
3,047,794 A * 7/1962 Bennett et al. ..... 324/347
3,791,042 A * 2/1974 Bell ..... 340/853.8
4,047,430 A * 9/1977 Angehrn ..... 73/152.02

(Continued)

FOREIGN PATENT DOCUMENTS

DE 198 46 137 A1 7/1998

(Continued)

OTHER PUBLICATIONS

International Search Report for parent PCT application No. PCT/AU2005/000076, dated Feb. 24, 2005, 2 pages.

*Primary Examiner* — Shane Bomar
*Assistant Examiner* — Cathleen Hutchins
(74) *Attorney, Agent, or Firm* — Miller, Matthias & Hull LLP

(57) ABSTRACT

A method of surveying drill holes, typically for use in underground mining situations where the holes are bored using a top hammer drill rig (10), utilizes a survey tool located adjacent the drill bit (1) which is used to log position readings as the drill string is withdrawn from the hole after the drilling operation. In this manner, it is possible to log the actual hole bored by the drill string (3) in real time as the drilling operation proceeds, and show deviation from intended hole positions (5) or (6). The survey tool typically includes an inertial survey package, a power source, and a data logger with the survey package selected from the group comprising commercially known inertial known survey packages, for superior characteristics of resistance to vibration and impact. The survey tool is maintained in a sleeping mode while drilling is undertaken, and activated to provide position data as the drill string is progressively withdrawn from the actual hole path (3).

7 Claims, 2 Drawing Sheets

U.S. PATENT DOCUMENTS 4,329,647 A * 5/1982 Freedman ..... 324/323
4,542,647 A * 9/1985 Molnar ..... 73/152.54
4,799,546 A * 1/1989 Hensley et al. ..... 166/254.2
5,044,198 A * 9/1991 Ho ..... 73/152.49
5,589,825 A * 12/1996 Pomerleau ..... 340/854.9
5,852,587 A * 12/1998 Kostek et al. ..... 367/25
5,899,958 A * 5/1999 Dowell et al. ..... 702/6
6,453,239 B1 * 9/2002 Shirasaka et al. ..... 701/220
6,769,497 B2 * 8/2004 Dubinsky et al. ..... 175/27
7,142,985 B2 * 11/2006 Edwards ..... 702/6
2003/0111268 A1 * 6/2003 Alft et al. ..... 175/73
2004/0089475 A1 * 5/2004 Kruspe et al. ..... 175/45
2005/0078555 A1 * 4/2005 Tang et al. ..... 367/31
2007/0235227 A1 * 10/2007 Kirkhope et al. ..... 175/73

FOREIGN PATENT DOCUMENTS

DE 198 46 137 4/2000
GB 2 070 105 A 9/1981

* cited by examiner

AUTOMATED DRILL STRING POSITION SURVEY

CROSS-REFERENCE TO RELATED APPLICATION

This is the U.S. National Phase of International Application No. PCT/AU2005/000076, filed on Jan. 24, 2005 claiming priority to Australian Patent Application No 2004900298, filed on Jan. 22, 2004.

FIELD OF THE INVENTION

This invention relates to an automated drill string position survey and has been devised particularly though not solely to survey drill holes formed by "top hammer" drills.

BACKGROUND OF THE INVENTION

In many different applications for example, in underground hard rock mines, it is extremely valuable to have timely and accurate knowledge of drill hole positions. Drill holes, commonly referred to as long holes (i.e. long hole drill and blast) are typically used for the placing of explosives in mining via open stoping, sub level stoping, block caving, vertical crater retreat methods, and sub level caving. It is useful in any underground mining that requires the drilling of long holes to distribute explosives through the rock or to run services through rock. There are however, parallel surface mining applications using top hammer machines where accurate survey is also necessary.

Underground mining by open or sub level stoping methods recovers the ore in open stopes, normally backfilled after being mined out. The stopes are excavated voids in the rock, typically with largest dimensions in a vertical direction. The ore body is divided into separate stopes for sub level open stope mining. Such a configuration is typically shown in FIG. 4 where the underground stopes 22 are formed using sub level drifts 23 strategically located as the base for a long hole drilling rig to drill a long hole blast pattern typically shown by radial lines 24. The ore is typically removed through trough undercuts 25 to draw points 26.

Between the stopes, ore sections are set aside for pillars to support the hanging wall. Pillars are normally shaped as vertical beams across the ore body. Horizontal sections of ore are also left to support mine workings above the producing stopes, known as crown pillars. Ensuring the stability of the surrounding rock mass influences mining efficiency favourably. The stability is strongly influenced by the accuracy and precision of the long hole drilling undertaken as part of the mining process.

Sub level drifts for long hole drilling are prepared inside the ore body, in between main levels. Drifts are strategically located as the base for the long hole drilling rig, to drill the long hole blast pattern typically shown at 24. Adherence to the drill pattern is a most important step for long hole blasting. The drill pattern specifies where blast holes are collared, depth and angle of each hole. All parameters are set with high precision for successful performance of the long hole blast. If the pattern of long holes deviates from the desired plan this can result in dilution of the ore body by drilling outside the design area, the creation of oversize broken rock caused by lower charge density between wandering holes, and Hanging Wall/Foot Wall damage hence stability issues through increased charge density.

Long holes are currently drilled as "up holes", "down holes", "rings" or in a "fan" pattern. Through practical working height restrictions in underground operations, such as in the sub level drifts 23, drilling rigs have short drill rod lengths and corresponding short feed and boom lengths to ensure ease of operation. In order to maximise mining efficiency, drilling sub levels are spaced as sparingly as possible resulting in a requirement for drilling holes many times the available rod length. These rods are typically between 1.2 meters and 3 meters long while the long holes may be over 60 meters in length.

Consequently each drill rig will have multiple rods available and often have an automated "carousel" of rods that can be inserted into the drill string as the bit is advanced. As the number of rods in the hole increases, the number of joints increases and the accuracy of the drilling process diminishes. To drill a hole, the first rod and bit is "collared" as close as possible to the surveyed position with the correct alignment to produce the desired hole. Once collared, the hole alignment is checked and the drilling process begins with a new rod added as the string advances in the hole.

Upon completion, the hole is flushed with water to remove cuttings and the rod is then retracted from the hole.

The existing technology to accurately survey drill holes requires a survey after completion of the hole. This is necessary because long holes are typically drilled by top hammer drills which introduce percussive force down the drill string as part of the drilling operation. Although technology to survey drill holes in real time (i.e. as part of the drilling operation) exists in applications where the drill string is not subject to top hammer conditions, it is not hitherto been possible to use survey tools in real time with top hammer drills due to the destructive nature of the percussive force in the drill string.

Although some top hammer drilling equipment manufacturers claim to complete real time survey as an onboard function, they rely on a critical assumption that the holes once commenced will always be straight. In practice this is not the case and holes may deviate significantly as their length increases. Typically, a survey using such equipment consists only of providing a hole length and direction assumed from parameters that can be recorded on the drilling rig.

The only presently available accurate survey method for operators of top hammer drills is post drilling survey which requires the lowering of a survey tool into the hole after the hole has been drilled, flushed and the rig moved on to a different hole location. This is a time consuming and costly task that may eventually identify hole characteristics but if deviation outside allowable constraints has occurred, then relies on significant corrective action being undertaken as a secondary or tertiary process after the top hammer drill rig has moved from the drilling site.

No real time survey technology exists that can withstand the down hole vibration and acceleration that is associated with a top hammer drill and ascertain the true path of the hole before completion and relay the data ultimately to decision making software.

In addition, many current systems, which rely on changes in the earth's magnetic field to determine position, cannot be accurately used in magnetic environments.

SUMMARY OF THE INVENTION

The present invention therefore provides a method of surveying drill holes comprising the steps of feeding a survey tool into a borehole on the end of a drill string as part of the hole drilling operation, activating the survey tool once drilling is completed, and taking position readings from the survey tool as the drill string is withdrawn from the hole.

Preferably, the survey tool is maintained in a sleeping mode while drilling is undertaken.

Preferably, the survey tool is configured to sense the cessation of drilling to activate the survey tool once drilling is completed.

Preferably, the position readings are taken from the survey tool as the withdrawal of the drill string is temporarily halted for the removal of each drill rod from the drill string.

BRIEF DESCRIPTION OF THE DRAWINGS

Notwithstanding any other forms that may fall within it's scope, one preferred form of the invention will now be described by way of example only with reference to the accompanying drawings in which.

DETAILED DESCRIPTION OF PREFERRED EMBODIMENTS OF THE INVENTION

Figure 4:
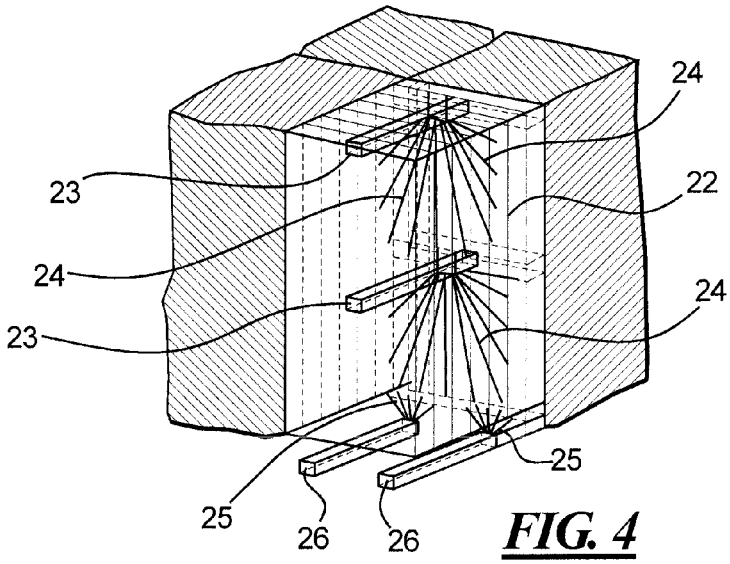
FIG. 4 is a diagrammatic underground view of an open stope mining configuration.

In the preferred form of the invention a top hammer drill rig 10 is positioned in an access/drill drive 9 of the type generally shown at 23 in FIG. 4 and described earlier with reference to the prior art.

The top hammer drill rig includes a hydraulic powered drifter 11 mounted on a drifter feed rail 12, typically held in place by bracing stingers 7 and 8 which brace the top hammer drill into the floor and roof respectively of the access/drill drive 9.

The top hammer drill rig is fed with drilling rods from a carousel (not shown) from where they are fed into a tool handler (not shown) and held by a clamp 13.

The rig is provided with a survey tool, described below, which can feed information to a receiver 15 mounted on an automated drill string position survey home unit 16 on the drill rig.

Figure 3:
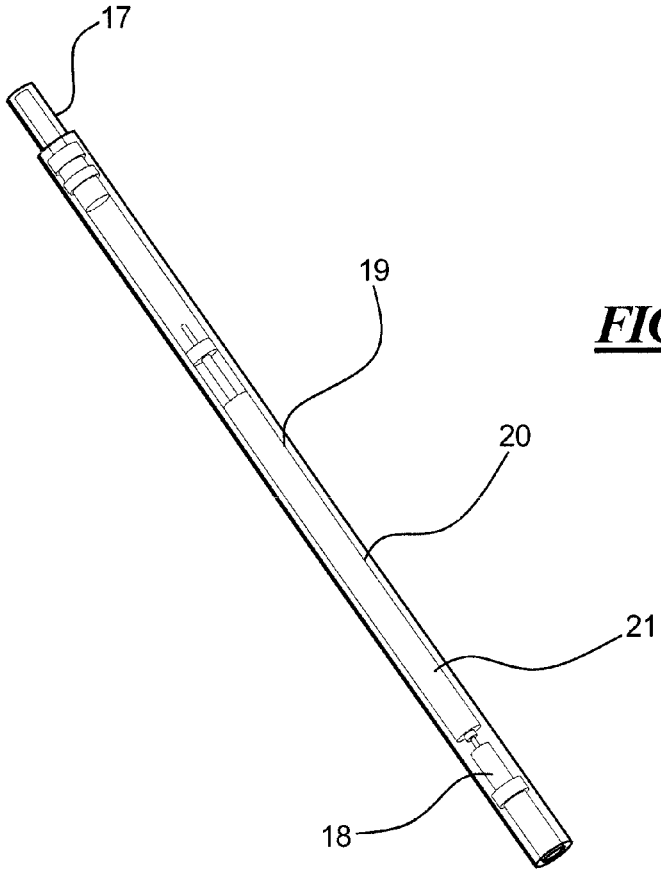
FIG. 3 is an enlarged view of the drilling tool used in FIG. 1.

The drill string 3 is provided at the cutting end with a drill bit 1 described in more detail with reference to FIG. 3.

Just above the drill bit 1 there is located a damping system 18 connected in turn to an inertial survey package 21. The purpose of the damping system 18 is to isolate the electronics module (comprising 19,20,21) from vibrations and acceleration induced in the drill tube/tool body 17. The survey package 21 feeds measured data into a data logger 20 powered by a power source in the form of batteries 19.

The inertial survey package 21 typically incorporates survey tools of a general type commercially known for use in non-percussive drilling, but carefully selected for their resistance to vibration and impact. Such tools can be typically sourced from navigational instruments designed for use in war head missiles etc.

The survey tools may also be selected so as to be substantially unaffected by magnetic fields thereby allowing use of the invention in magnetic environments.

Figure 1:
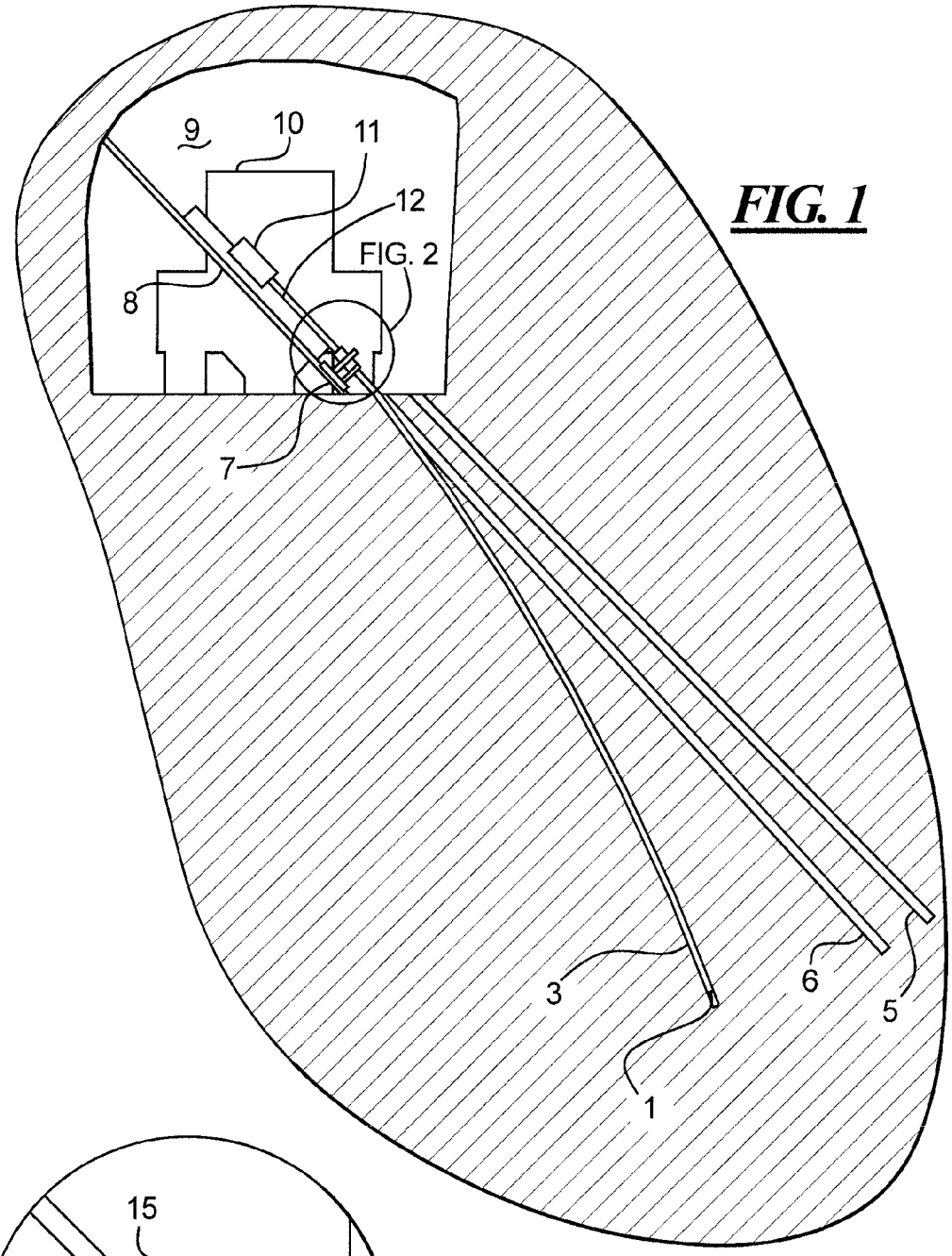
FIG. 1 is a diagrammatic cross sectional elevation through a mine showing the drilling of a borehole using a top hammer rig.
Figure 2:
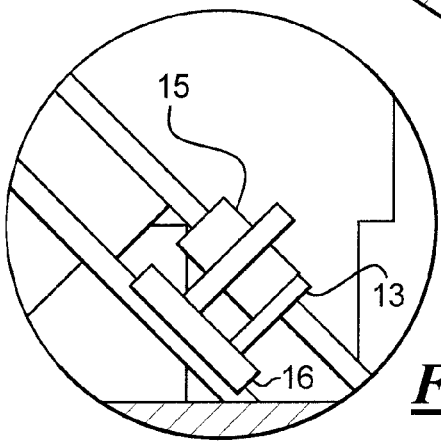
FIG. 2 is an enlarged view of section A of FIG. 1.

When a long hole is drilled using a top hammer drill according to prior art methods, the design (ideal) hole position shown at 5 (FIG. 1) is initially determined by traditional survey techniques and is marked accordingly. The hole length and direction are calculated to produce the most efficient result, usually output from a mine design package or survey software. In practice, the hole position is determined by the operator matching the parameters such as collar position and angle that can be determined on the drilling rig 10 to the design position provided to him/her. In practice, this may cause the hole position to be drilled at 6 and logged as 5, introducing error into the longhole practice even before drilling commences.

Because of the flexible nature of the multiple rod drill strings, it is common for the actual hole path to deviate from 5 or 6 by a significant amount as shown at 3. The automated drill string position survey tool and method according to the invention allows the plot of the actual hole path 3 to be accurately determined in real time as part of the drilling operation so that the subsequent holes may be realigned or more accurately placed to achieve the desired borehole pattern and control the charge density and placement.

This invention allows the survey of a hole during the process of drilling and retrieving the drill string from the drill hole. The batteries, data logging, electronics and inertial sensors are housed in a sealed unit 19, 20, 21, that is largely isolated (damped) from the vibration and acceleration caused by the percussive top hammer drive. The tool will typically "sleep" while the hole is advanced and then wake up and record data as each drill rod is retracted. When the rods are stationery and the carousel in operation, the tool will be aware that it has travelled the length of the rod. In this fashion, the time the sensors measure is limited and therefore the drift (hence error) reduced. Importantly, the top hammer will not be in operation during the retraction of the drill string, minimizing the chance of damage to the inertial sensors while they are in operation.

As the retraction of the rods is completed, the data recorded is transmitted to a drill rig mounted receiver and the actual path of the hole 3 displayed against the design path 5. After each hole some calibration will be completed to compensate for drift/error prior to starting the next hole. The data can be downloaded and transformed by a laptop computer and cable connection although it is possible to ultimately mesh the drilling data seamlessly into the mine survey data.

In developments of the invention, the data will be stored, transformed and transmitted in a wireless fashion to allow mine engineers to determine if a certain hole is outside design parameters. This can be fully automated and tied in with the design software, to make changes automatically for the next hole.

The data may also be used to determine if a hole deviates into waste or into the area of influence of other holes when it would not be loaded fully with explosive or maybe initiated earlier or later in the sequence.

In this manner, it is possible to provide a survey tool for use with a top hammer drilling rig that enables accurate real time survey of the hole being drilled to allow subsequent holes to be adjusted to compensate for wandering of the earlier hole from design parameters. This significantly reduces the time for survey required in an underground mining operation and results in safer and more efficient mining practices.

Although the invention has been described with reference to specific examples it will be appreciated by those skilled in the art that the invention may be embodied in many other forms.

The invention claimed is:

1. A method of surveying drill holes comprising the steps of:

drilling a borehole with a drill string formed by a plurality of drill rods having a drill bit located at a cutting end of the drill string and being driven at least by percussive forces, wherein an inertial survey package is disposed within the drill string at the cutting end and advances with the drill string into the borehole while the drill string is operational to drill the borehole as part of a hole drilling operation, and wherein the survey tool is maintained in a sleeping mode while drilling is undertaken;

activating the survey tool once drilling is completed;

withdrawing the drill string from the borehole;

determining when the drill string is halted during the withdrawing of the drill string from the borehole; and taking position readings from the survey package as withdrawal of the drill string is temporarily halted to remove each drill rod from the drill string in response to determining that the drill string is halted during the withdrawal of the drill string from the borehole.

2. A method as claimed claim in 1, wherein the survey tool is configured to sense the cessation of drilling to activate the survey tool once drilling is completed.

3. A method of surveying drill holes comprising the steps of:

feeding a survey tool disposed within a drill string formed by a plurality of drill rods into a borehole while the drill string is operational to drill the borehole as part of the hole drilling operation, wherein the drill string is driven at least by percussive forces, and wherein the survey tool is maintained in a sleeping mode while drilling is undertaken;

activating the survey tool once drilling is completed;

withdrawing the drill string from the borehole;

determining when the drill string is halted during the withdrawing of the drill string from the borehole; and taking position readings from the survey tool as withdrawal of the drill string is temporarily halted to remove each drill rod from the drill string in response to determining that the drill string is halted during the withdrawal of the drill string from the borehole, wherein the survey tool includes an inertial survey package and a power source.

4. A method as claimed in claim 3, wherein the survey tool also includes a data logger.

5. A method as claimed in claim 3, wherein the survey tool is mounted to the drill string by a damping system arranged to isolate the survey tool from vibrations and acceleration induced in the drill string.

6. A method as claimed in claim 3, wherein the inertial survey package is selected from the group comprising commercially known inertial survey packages, for superior characteristics of resistance to vibration and impact from a group comprising commercially known inertial survey packages.

7. A method as claimed in claim 6, wherein the inertial survey package is selected for superior resistance to vibration and impact when in a sleeping mode.

* * * * *